US006174577B1

(12) United States Patent
Vitorino

(10) Patent No.: US 6,174,577 B1
(45) Date of Patent: Jan. 16, 2001

(54) ANTI-STATIC BALL AND A METHOD OF USING THE SAME

(76) Inventor: Tony Vitorino, 69 Sylvia St., New Bedford, MA (US) 02745

( * ) Notice: Under 35 U.S.C. 154(b), the term of this patent shall be extended for 0 days.

(21) Appl. No.: 09/132,910

(22) Filed: Aug. 12, 1998

(51) Int. Cl.[7] ..... B32B 5/18

(52) U.S. Cl. ..... 428/36.5; 428/36.6; 428/36.8; 510/519; 68/235 R

(58) Field of Search ..... 428/36.5, 35.7, 428/131, 138, 36.6, 36.8; 510/513, 515, 519, 439, 44 J; 427/242; 34/389, 60, 380; 68/235 R; 473/569, 598, 600; D21/713, 780, 781; 239/59, 57

(56) References Cited

U.S. PATENT DOCUMENTS

| | | | | |
|---|---|---|---|---|
| 3,633,538 | * | 1/1972 | Hoeflin | 118/76 |
| 3,696,034 | | 10/1972 | Hewitt et al. | 252/8.8 |
| 3,706,140 | * | 12/1972 | Brillaud et al. | 34/60 |
| 3,870,145 | | 3/1975 | Mizuno | 206/84 |
| 4,014,105 | * | 3/1977 | Furgal et al. | 34/12 |
| 4,057,673 | | 11/1977 | Falivene | 428/411 |
| 4,532,719 | * | 8/1985 | Davies et al. | 34/12 |
| 4,532,722 | * | 8/1985 | Sax | 34/60 |
| 4,659,496 | | 4/1987 | Klemm et al. | 252/90 |
| 4,828,746 | | 5/1989 | Clauss et al. | 252/90 |
| 5,002,681 | | 3/1991 | Wierenga et al. | 252/90 |
| 5,425,887 | | 6/1995 | Lam et al. | 252/8.6 |

* cited by examiner

*Primary Examiner*—Ellis Robinson
*Assistant Examiner*—Alicia Chevalier
(74) *Attorney, Agent, or Firm*—Richard C. Litman

(57) ABSTRACT

A reusable environmentally friendly chemical free anti-static ball and a method of using the same in an automatic heated tumble laundry dryer in order to reduce the build up of electrostatic charges and thereby reduces static cling and annoying electrical shocks produced in the laundry, without the use of any chemical anti-static fabric conditioning agents. The anti-static ball preferably consists of a one-piece porous inner foam ball and a two piece outer shell of a shape retaining molded plastic. The outer shell contains apertures or holes that permit communication between the inner foam ball and environment that surrounds the anti-static ball.

6 Claims, 1 Drawing Sheet

ANTI-STATIC BALL AND A METHOD OF USING THE SAME

BACKGROUND OF THE INVENTION

1. Field of the Invention

The present invention relates to a reusable environmentally friendly chemical free anti-static ball and a method of using the same in an automatic heated tumble laundry dryer in order to reduce the build up of electrostatic charges and therefore reduce static cling and annoying electrical shocks produced in the laundry, without the use of any chemical anti-static fabric conditioning agents.

2. Description of Related Art

The advantages obtained from the use of chemical fabric conditioning agents, which include, but are not limited to anti-static and fabric softening compounds, either alone or coated on a substrate, for conditioning laundered fabrics are well known in the art. However, a major disadvantage associated with the usage of these compounds, and/or the substrates upon which they may be coated, is the amount of waste each generates from discarded plastic jugs and spray bottles that contain fabric conditioning/softening/anti-static chemical compounds, to the plethora of single use anti-static laundry sheets that are used with the laundry while in the dryer and that must also be discarded after only a one use. The present invention solves these, as well as other problems associated with the use of these compounds, and/or the substrates upon which they may be coated, while reducing electrostatic charges that buildup in laundry dried in an automatic heated tumble laundry dryer, with a reusable anti-static ball that is environmentally friendly because it is does not contain any fabric conditioning/softener/anti-static chemical compounds, and because it can be used over and over again, thereby greatly reducing the amount waste generated. The prior art discloses various methods of reducing or preventing electrostatic charges that build up in tumble dried laundry by relying on fabric conditioning/softener/anti-static chemical compounds. However, none of the art prior references, including those recited below, teach a reusable anti-static ball that contains no added anti-static fabric conditioning/softener chemical agents.

U.S. Pat. No. 5,002,681 issued on Mar. 26, 1991 to Wierenga et al. discloses fabric softener compositions, delivered by a sheet or pouch, that are included along with the laundry in both the washing and drying cycles. The fabric softener compositions also have anti-static properties.

U.S. Pat. No. 4,057,673 issued on Nov. 8, 1977 to Falivene discloses a form-retaining substrate coated with a fabric conditioning anti-static compound that is placed amongst damp laundry in an automatic laundry dryer in order to reduce static buildup when the laundry is heated and tumble dried.

U.S. Pat. No. 3,696,034 issued on Oct. 3, 1972 to Hewitt et al. discloses a porous foam substrate coated with a nonionic fabric softening and anti-static coating compounds, wherein the coating compounds penetrate below the surface of the substrate and into the pores. The coated porous foam substrate is placed amongst damp laundry in an automatic laundry dryer in order to reduce static buildup when the laundry is heated and tumble dried.

None of the above inventions and patents, taken either singly or in combination, is seen to describe the instant invention as claimed.

SUMMARY OF THE INVENTION

The present invention pertains to a reusable, environmentally friendly chemical free anti-static ball and a method of using the same. The anti-static ball preferably consists of three pieces: a one piece porous inner foam ball and a two piece outer shell of a molded form retaining plastic. The two piece outer shell contains apertures or holes that permit communication between the inner foam ball and the environment that surrounds the anti-static ball.

Accordingly, it is a principal object of the invention to provide an anti-static ball, with or without the outer plastic shell, that reduces the build up of electrostatic charges and thereby reduces static cling and annoying electrical shocks produced in the laundry, without the use of any chemical anti-static fabric conditioning agents.

It is another object of the invention to provide an environmentally friendly anti-static ball, that unlike commercially available dryer sheets and the like, can be reused repeatedly, thereby minimizing waste.

It is a further object of the invention to provide a scented anti-static ball, with or without the outer plastic shell, that can be used in an automatic heated tumble laundry dryer to impart upon the laundry being dried a pleasant and desirable fragrance, while simultaneously reducing electrostatic charges in the laundry.

Still another object of the invention is to provide a scented anti-static inner ball, with or without the outer plastic shell, and capable of imparting a desirable and pleasant fragrance in any enclosed location such as drawers, closets, lockers, automobiles and the like, where it is stored.

It is an object of the invention to provide improved elements and arrangements thereof in an anti-static ball for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
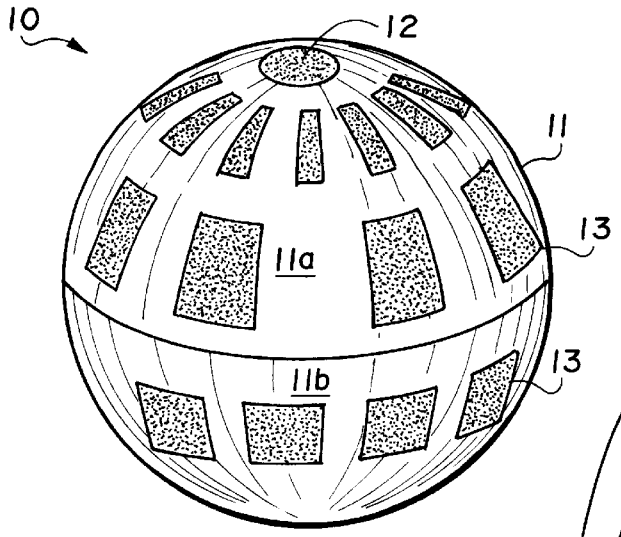
FIG. 1 is an external perspective view of an assembled, three piece anti-static ball according to one embodiment the present invention.
Figure 2:
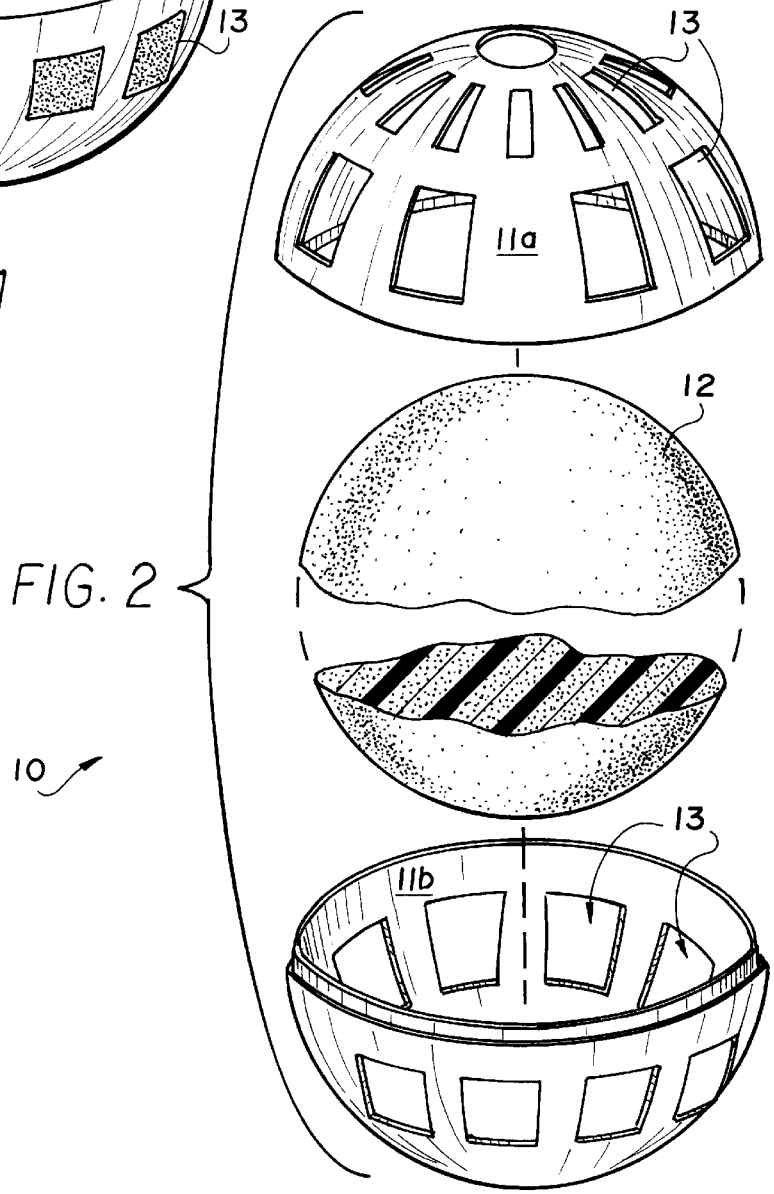
FIG. 2 is an exploded perspective of a three piece anti-static ball according to one embodiment the present invention.

As seen in FIGS. 1 and 2 the present invention is a reusable, environmentally friendly chemical free three piece anti-static plastic ball 10 that can be used in a heated tumble laundry dryer in order to reduce the build up of electrostatic charges, and thereby reduce static cling and annoying electrical shocks produced in the laundry, without the use of any chemical anti-static fabric conditioning agents. The anti-static ball 10 preferably consists of three pieces: a porous inner foam ball 12 and a two piece outer shell 11 of a molded form retaining plastic each capable of withstanding the heat of a typical automatic heated tumble dryer of about 155° F. to 165° F. The outer shell 11 contains apertures or holes 13 of any shape or size that allow for communication between the inner foam ball 12 and the environment that surrounds the anti-static ball 10.

The porous one piece inner foam ball 12 is preferably a flexible, foam, polymeric plastic selected from the group consisting of polyurethanes, polyesters, polystyrenes, polyvinyl chlorides or nylons. Preferable polyurethanes that can be used are high and low density foam (poly)urethanes. Representative examples of the flexible foam polyurethanes that can be used in the present invention include, but are not limited to, flexible foam polyurethanes used to make seat cushions, mattresses, carpet underlays and the like. The production of foam and molded plastics is conventionally known. Fragrance can be added to the porous inner foam ball 12 if a scent is desired.

The unassembled anti-static ball 10 in FIG. 2 consists of the outer shell halves 11*a*, 11*b* and a one piece inner 12 ball. The inner ball 12 is placed inside one-half of the outer shell 11 and then the two halves of the outer shell 11 are adhered together, via any appropriate adhesive material that can withstand the high temperature of an automatic heated tumble laundry dryer, thereby encapsulating the porous inner ball 12.

The present invention also teaches a method of reducing the build up and/or the production electrostatic charges in laundry dried in an automatic heated tumble laundry dryer. The process involves placing damp and/or wet, preferably recently washed laundry into an automatic heated tumble laundry dryer, along with an uncoated and chemically untreated anti-static ball, with or without the outer plastic shell, having no fabric conditioning chemicals, such as fabric softeners or anti-static agents applied thereto. Next, the dryer is activated or turned on in order to properly tumble dry, in a heated environment, the laundry, and also allow the anti-static ball to come into constant and repeated contact with the laundry, until the laundry is substantially dry.

The anti-static ball used in this process can be either the three piece anti-static ball comprising outer shell halves 11*a*, 11*b* and a porous one piece inner 12 ball, or a porous one piece anti-static foam ball that lacks the two piece outer plastic shell. Either the three piece or the one piece anti-static ball can be used with the disclosed process, so long as either one is not coated with any fabric conditioning chemical agents such a fabric softeners and/or an anti-static agents.

It is to be understood that the present invention is not limited to the sole embodiments described above, but encompasses any and all embodiments within the scope of the following claims.

I claim:

1. A reusable three piece anti-static ball consisting of:

a one piece porous inner foam ball; and a two piece outer shell of a shape retaining molded plastic surrounding the inner foam ball, each piece of said two piece shell containing apertures that permit communication between the inner foam ball and the outer environment that surrounds the anti-static ball;

wherein said one piece inner foam ball and said two piece outer shell being environmentally safe and being free of any added anti-static agent.

2. The reusable anti-static ball according to claim 1, further comprising a fragrance applied to the inner foam ball.

3. The reusable anti-static ball according to claim 1, wherein the inner foam ball is a polymeric plastic foam selected from the group consisting of polyurethanes, polyesters, polystyrenes, polyvinyl chlorides or nylons.

4. The reusable anti-static ball according to claim 1, wherein the outer shell is a form retaining plastic having the characteristic of withstanding the heat of a typical automatic heated tumble dryer heated to a temperature range of 155° F. to 165° F. without loss of form.

5. A method of reducing electrostatic charges in laundry dried in a dryer comprising:

a) placing damp laundry in a heated tumble laundry dryer;

b) placing a reusable anti-static ball consisting of an inner foam ball encased in a two piece outer ball shell into the heated tumble laundry dryer along with the damp laundry, whereby the inner foam ball and the two piece outer shell are free of any fabric conditioning chemicals applied thereto and each piece of the two piece outer ball shell has a plurality of apertures therethrough;

c) activating the heated tumble laundry dryer such that the laundry and the anti-static ball come into constant and repeated contact with each other until the laundry is substantially dry;

whereby the anti-static ball being environmentally safe.

6. The method according to claim 5, wherein the foam ball is a foamed urethane.

* * * * *